US006969009B2

(12) United States Patent
Bachmaier et al.

(10) Patent No.: US 6,969,009 B2
(45) Date of Patent: Nov. 29, 2005

(54) INJECTOR, ESPECIALLY FUEL INJECTION VALVE, WITH A PIEZOELECTRIC ACTOR

(75) Inventors: Georg Bachmaier, München (DE); Bernhard Fischer, Töging A. Inn (DE); Bernhard Gottlieb, München (DE); Andreas Kappel, Brunnthal (DE); Hans Meixner, Haar (DE); Tim Schwebel, Augsburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/671,504

(22) Filed: Sep. 29, 2003

(65) Prior Publication Data

US 2005/0072863 A1 Apr. 7, 2005

(30) Foreign Application Priority Data

Sep. 27, 2002 (DE) ..... 102 45 109

(51) Int. Cl.[7] ..... B05B 1/08; F02M 47/02

(52) U.S. Cl. ..... 239/102.2; 239/585.1; 239/585.3; 239/128; 239/88; 239/89; 239/91

(58) Field of Search ..... 239/102.2, 585.1, 239/585.2, 585.3, 585.4, 585.5, 128, 127.1, 239/88, 89, 90, 91, 82, 93

(56) References Cited

U.S. PATENT DOCUMENTS

| | | | | |
|---|---|---|---|---|
| 4,943,004 | A * | 7/1990 | Takahashi | 239/95 |
| 6,079,636 | A * | 6/2000 | Rembold et al. | 239/88 |
| 6,279,842 | B1 * | 8/2001 | Spain | 239/585.1 |
| 6,386,185 | B1 * | 5/2002 | Cooke | 123/506 |
| 6,663,015 | B2 * | 12/2003 | Yamada et al. | 239/102.1 |

FOREIGN PATENT DOCUMENTS

| | | |
|---|---|---|
| DE | 199 40 055 C1 | 4/2001 |
| DE | 101 40 799 A1 | 3/2003 |
| DE | 102 44 614 A1 | 4/2004 |

* cited by examiner

*Primary Examiner*—David A. Scherbel
*Assistant Examiner*—Seth Barney
(74) *Attorney, Agent, or Firm*—Young & Thompson

(57) ABSTRACT

The jacket surface of the piezoelectric actor body (1) is surrounded by an injector housing (9), maintaining an intermediate space and is cooled by direct contact with an inert fluid which does not conduct electricity (6), forming a fluid space in the injector housing (9) which is filled with fluid except for an air reservoir (7). The volume of the air reservoir (7) is at least large enough to allow the thermal expansion of the heat coupling fluid (6) which occurs at the highest operating temperature of the actor body (1).

20 Claims, 4 Drawing Sheets

INJECTOR, ESPECIALLY FUEL INJECTION VALVE, WITH A PIEZOELECTRIC ACTOR

FIELD OF THE INVENTION

The invention relates to an injector, in particular to a fuel injection valve of motor vehicles, with a piezoelectric actor body, especially in a multilayer design, of which the jacket surface is surrounded by an injector housing, maintaining an intermediate space, and is cooled by direct contact with an inert fluid which does not conduct electricity.

BACKGROUND OF THE INVENTION

An injector of this type is already known from German Patent application DE 199 40 055 C1.

As is generally known fuel injection valves equipped with piezoelectric multilayer actors can switch more quickly compared to conventional, electromagnetically activated fuel injection valves. However the design of an injector equipped with a piezoelectric actuator must take account of the fact that heat is lost through losses within the body of the actor and this must be removed so that the actor does not overheat. This heating up can damage or destroy the actor through thermal expansion of the actor body. On the other hand it is possible through the additional internal heating up of the actor body for the Curie temperature to be exceeded when the internal combustion engine is working at a high temperature level, since the direct injection into the combustion chamber subjects the injector to high ambient temperatures right from the start.

Impermissibly approaching or even exceeding the Curie temperature must be prevented in any event since otherwise there is the danger of the piezoceramic depolarizing and the actor losing lift.

Although the present invention is applicable to any injector with piezo actor and intermediate space (from actor to injector housing) it becomes particularly significant in relation to applications in which, for operation of high-pressure injection valves for direct fuel injection with a piezoelectric multilayer actor (PMA) as drive element—both for diesel and for gasoline engines—the aim is for multiple injection to optimize the combustion process. With the diesel engine pilot injection achieves a conditioning of the mixture so that after the main injection there is an even combustion process. With the gasoline engine on the other hand a leaner mixture will be more safely ignited by an explicit secondary injection enriching the mixture in the area of the spark plug.

Further development is generally moving in the direction of continuous injection rate forming, to further improve consumption and exhaust gas values and to reduce the noise generated. Concepts with up to five injections per combustion process have already been discussed. Accordingly the actor is to be activated with an ever higher frequency, whereby however, in the piezoceramic of the actor, as previously described, even more waste heat will then be produced. This waste heat can currently not be very well removed since the piezoceramic is typically surrounded by air so that heat can basically only be effectively removed directly or indirectly via the ends of the actor body.

A dosing valve with piezo actor is known from DE 199 40 055 C 1 cited at the start, in which the actor space (intermediate space), of a hydraulic chamber and an equalization space are hydraulically linked and filled without bubbles with a pressurized hydraulic fluid, in order to form a dynamic (i.e. with the given injection times in the milliseconds range) rigid support for the piezo actor and a hydraulic length equalization element for longer lasting processes. In this connection actors of the "closed" type, in which the actor is encapsulated by a metal bellows positioned in the space, as well as actors of the "open" type are discussed. The patent application mentions that with a more expensive "open" special version compared to the metal bellows, with an actor incorporated into a tubular spring, by direct contact of the actor with the hydraulic fluid, for example silicon oil, advantageously produces heat dissipation to the environment (not specified in more detail).

SUMMARY OF THE INVENTION

The object of the invention is to create an injector of the type mentioned at the start in which the actor is sufficiently protected against overheating to guarantee problem-free operation, even with a number of injections per combustion process.

In accordance with the invention the injector, especially a fuel injection valve of motor vehicles is provided with a piezoelectric actor body especially in a multilayer version, of which the jacket surfaces are surrounded by an injector housing with an intervening space and are cooled by direct contact with an inert, piezoelectric non-conducting fluid In the injector housing a fluid space is formed filled with a heat coupling fluid except for an air reservoir, whereby the actor body is in direct contact with the fluid over at least part of its length which removes the actor heat in a lateral direction from the actor body. The volume of the air reservoir to be provided is in this case to be simultaneously at least large enough to allow the thermal expansion of the heat coupling fluid occurring at the maximum operating temperature of the actor body.

The idea behind the invention is thus based on filling the inside of the injector with an inert, non-conducting fluid with the highest possible heat conductivity to allow better removal of the waste heat of the actor. The additional lateral heat coupling to the surrounding injector housing thus allows impermissible heating up of the actor even at high operating frequencies to be safely avoided.

In the sense of the invention liquids, liquid mixtures, fats, oils, pastes (especially heat dissipation paste), suspensions (to increase the conductivity) etc. with the given characteristics, in particular with a high dielectric constant, can be used as heat coupling fluids.

The invention is further based on the recognition that it is necessary, especially to avoid pressure problems at the actor or the injector, to take account of the thermal expansion of the (relevant) fluid for the fill level of the heat coupling fluid in the fluid space, even if this reduces to a certain degree the area of the jacket surface of the actor body which has additional lateral heat removal. Therefore a precomputed sufficient air reservoir is provided in the fluid area.

The invention can be used especially with actors of the open and closed type:

With open actors it is of advantage that the intermediate space forms at least a part of the fluid space and is filled with the fluid over at least part of its length and that in the injector housing a separator device is provided in the area of the valve side end of the actor body so that in the fluid-filled part of the fluid space seals in the injector housing against an area which is adjacent to the injector valve. The separator device enables the medium to be injected (dosing fluid) to be kept away from the piezoceramic. It is of advantage if the actor body is incorporated into a tubular spring positioned in the cavity and is pretensioned by the latter, whereby the fluid forms a heat conducting bridge through the openings of the tubular spring between the actor body and the injector housing. In this way a low-cost open actor type with good lateral heat dissipation can be realized.

An injector with a closed actor type can be advantageously realized in that the actor body is incorporated into an axial encapsulation arranged in the intermediate space which divides the space into an actor internal space and an actor external space hydraulically sealed against it, whereby the actor internal space forms at least part of the fluid space and is filled with fluid over at least part of its length.

In accordance with a particularly advantageous form of embodiment of this actor type the actor external space is also filled over at least part of its length with a second heat-coupling fluid so that in this case too there is a quasi-composite heat conducting bridge from the actor body to the injector housing.

This embodiment can be easily combined with a hydraulic bearing for the actor body by providing a dynamically rigid hydraulic bearing supporting the actor body on the side way from the valve needle. The hydraulic bearing and actor external space are hydraulically connected and filled with a hydraulic liquid serving as a second heat coupling fluid and a sealing element is provided which seals the actor external space against a space adjacent to the injector valve.

With all embodiments it is of advantage for the actor body to be in direct contact with the fluid over its entire length and for the volume of the air reservoir to be connected to the fluid-filled part of the fluid chamber without any hydraulic restriction.

Exemplary embodiments of the invention are shown in the figures of the drawing and explained in more detail in the subsequent description. The figures show, schematically and in longitudinal or cross section in each case,

DETAILED DESCRIPTION OF THE INVENTION

Figure 1:
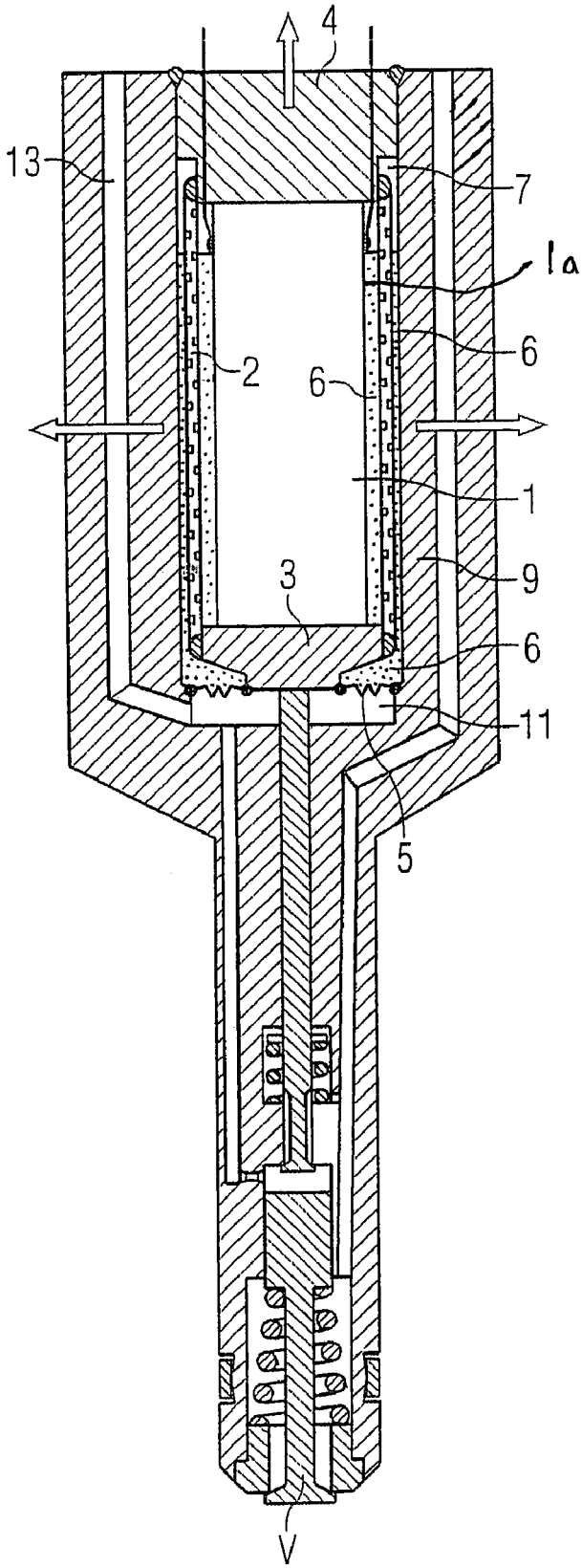
FIG. 1 a first form of embodiment of an injector in accordance with the invention, with an open actor type, FIG. 2 a part of a second exemplary embodiment, with an open actor type, FIG. 3 a part of a third form of embodiment with an injector in accordance with the invention, but with a closed actor type, FIG. 4 a fourth form of embodiment of an injector in accordance with the invention, with closed actor type.

FIG. 1 shows a multilayer design of an actor body 1 which is incorporated into a tubular spring 2 and is pretensioned by the latter. The actor body 1 is held in position at its upper end face by a header plate 4 which it is connected on its lower end face with a foot plate 3 which with a lengthening of the actor body 1 caused by electrical excitation is caused to perform a corresponding axial deflection which is converted directly or indirectly into the lift of a valve needle V. A flexible membrane 5 is hinged on the footer plate 3 on one side and on the injector housing 9 on the other side, which ensures horizontal sealing despite axial movement of footer plate 3. Valve chamber 11 can be refilled via feed lines 12 and 13 (see feed line 12 of FIG. 4) in the familiar way with dosing fluid. With such open type actors a movable separator such as the membrane 5 shown or a metal bellows is generally used to keep the dosing medium to be injected, typically gasoline, away from the relatively chemically sensitive piezoceramic.

The space between the jacket surface 1*a* of actor body 1 and the inner side of injector casing 9 is largely, but not completely, filled with a heat coupling fluid 6: in the upper area of this space a non-filled air reservoir 7 is recognizably retained, whereas the lower area, as a result of gravity is completely filled with the fluid 6. The fluid 6 penetrates through the openings in the tubular spring 2 and forms a heat conducting bridge from actor body 1 to injector housing 9. The main directions of heat flow shown by the arrows here (and in FIG. 4) make it clear that the removal of the heat is significantly improved overall in accordance with the invention by the lateral heat removal (which occurs in addition to the conventional removal of heat via header plate 4) via fluid 6 which has high heat dissipation properties. A part of fluid 6 is also located with this variant below the footer plate 3, that is outside the space defined above.

In manufacturing a heat conducting bridge for removing the waste heat generated in accordance with the efficiency of the actor, various general conditions are to be taken into consideration:

Fluid 6 must not damage the piezoceramic. It must therefore be non-conductive and chemically inert. A high dielectric constant $\epsilon_r$ is advantageous to homogenize the electrical field lines, whereby an increase in dielectric strength is also favorably produced. Therefore, as well as (degassed) silicon oil, glycerin is also particularly considered for fluid 6.

The fill level of the fluid space or the size of the air reservoir 7 which takes account of the complete thermal expansion of the fluid 6, i.e. is designed to allow for it, depends on the chosen fluid 6 and on the temperature range in which the injector is operated. Fuel injectors for motor vehicles are normally operated between −40° C. and +150° C. For safety reasons operating temperatures of up to +220° C. are allowed for. (Curie temperatures of piezoceramics are typically above +250° C.). Fluid 6 is filled for example at +20° C. (dT=200° C.) and has a volume expansion coefficient of 0,00125 [1/° C.]. The fluid 6 can then expand by 25% and the volume may be filled at most 80% with fluid 6.

Figure 2:
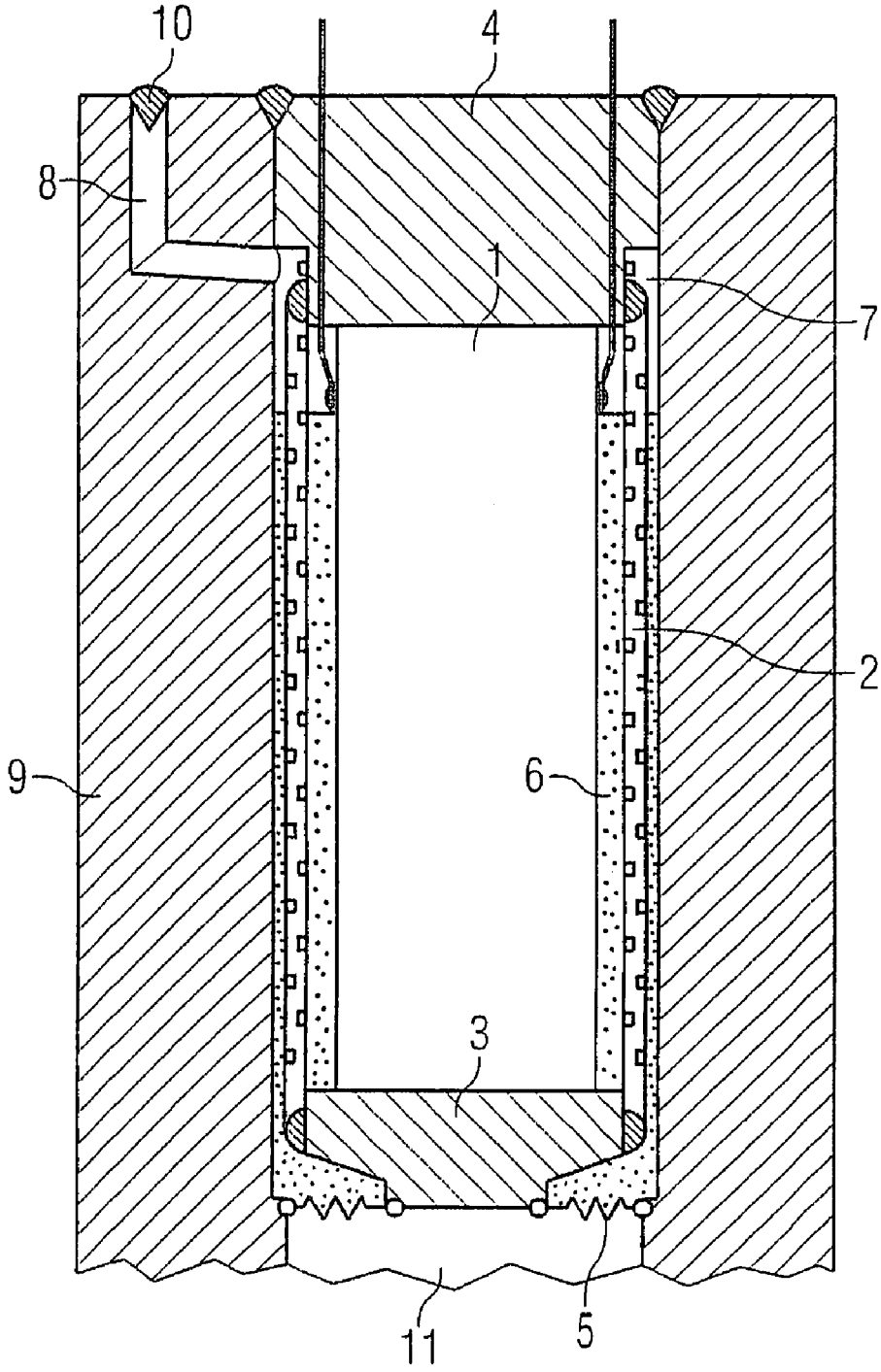

In practice the filling, as shown in FIG. 2, is simply to be effected via a filling hole 8, which after filling is provided with a seal 10, e.g. by laser welding or gluing. This is made easier by the fact that the volume is not filled up to the edge and is only filled non-pressurized with fluid 6.

Figure 3:
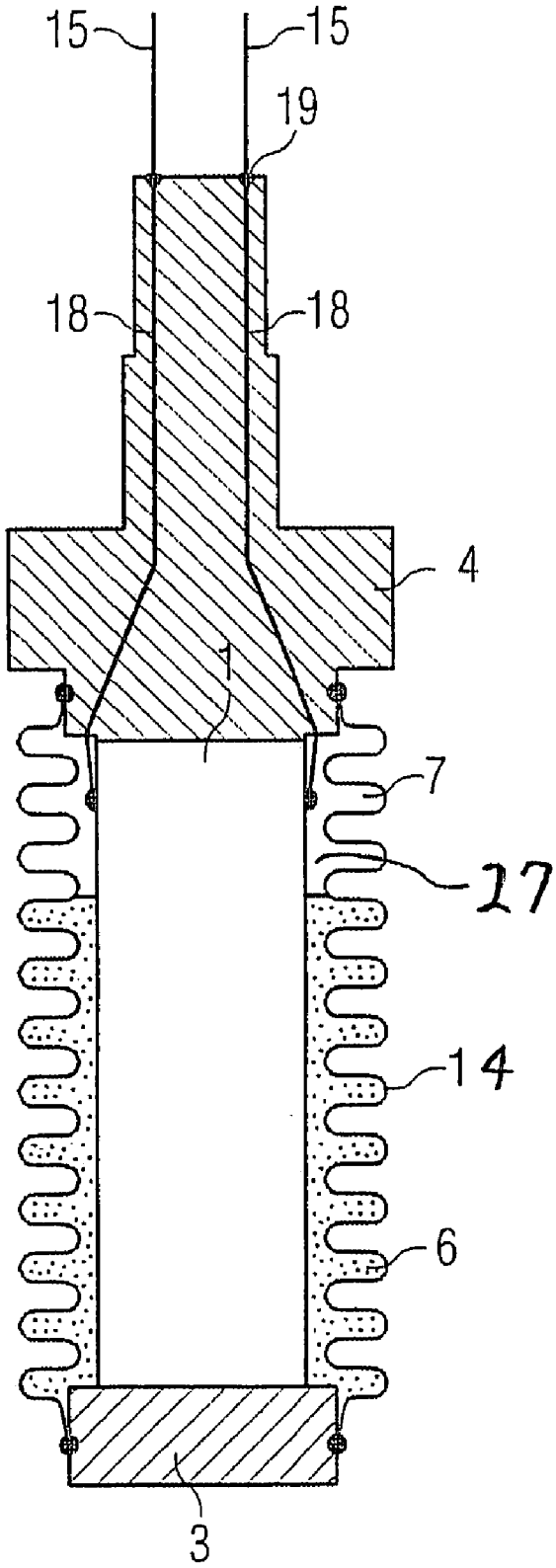

FIG. 3 shows an actor of the closed type in which the actor body 1 is encapsulated fluid sealed. This can, as shown, be realized particularly by welding actor body 1 into a fluid-sealed metal bellows 14. If the actor is triggered via the electrical connections 15 it expands. In this case the header plate 4 is supported against an opposing support (e.g. solid rear panel or hydraulic bearing) and the movable footer plate 3 is pressed downwards. The removal of the heat generated is again made easier in accordance with the invention when the actor internal space 27, that is the space between the metal bellows 14 and the actor body 1, is, as shown, is at least partly filled with the heat coupling fluid 6.

Figure 4:
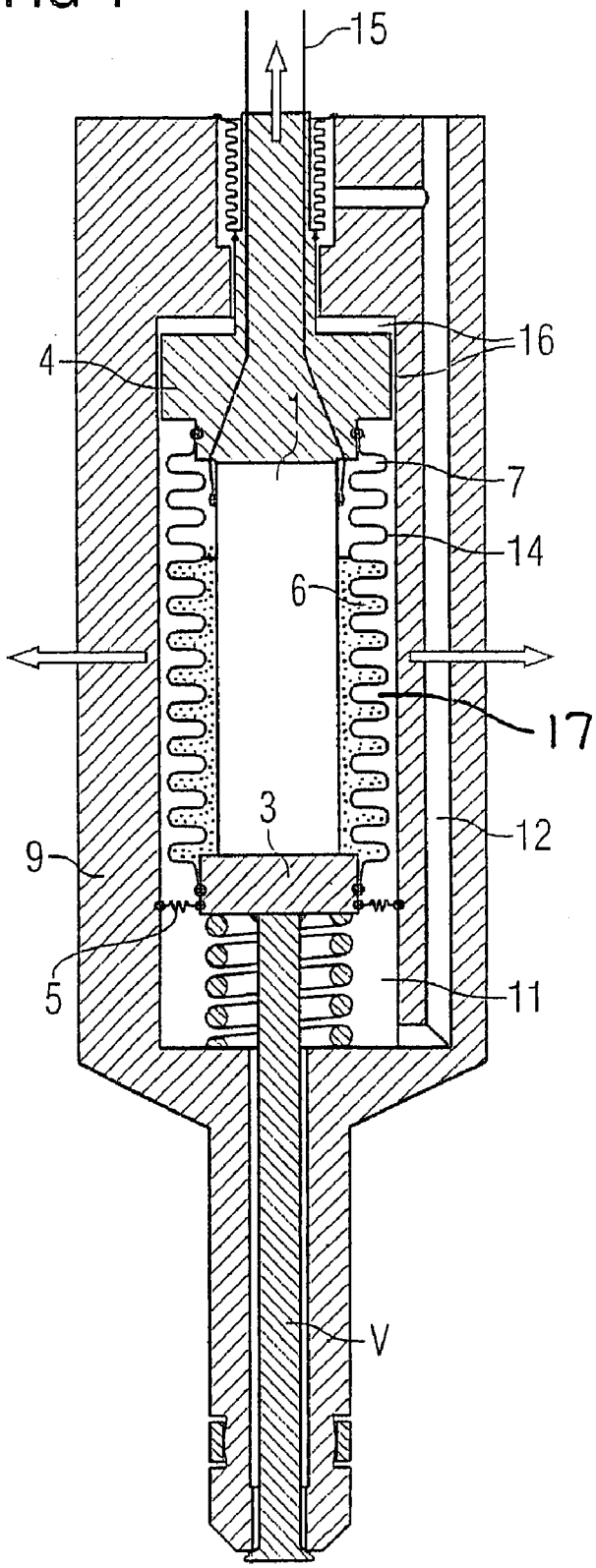

This is to be realized in an advantageous manner when the injector, as shown in FIG. 4, is operated with a familiar hydraulic bearing 16. It is particularly favorable if the actor external space 17 between the metal bellows 14 and the injector housing 9 is also filled with a second warm coupling fluid (not shown) that can be distinguished from the first warm-coupling fluid 6. It must in particular be neither chemically compatible with the piezoceramic nor non-conductive. This therefore increases the choice of the possible second heat coupling fluid. In particular a fluid that is already present in the injector, for example the gasoline itself, or the fluid, which is used for the hydraulic support 16, can be introduced as a second heat coupling fluid.

A closed actor can basically be filed via a separate filling hole 8, as shown in FIG. 2. With the holes for the electrical leads however one already has access to the interior of the actor 1, which can advantageously be used as a filling channel 18, cf. FIG. 3. After filling all access points must be provided with a seal 19, for example with a high-temperature adhesive.

With all versions the volume of the fluid space may not be completely filled with the heat-conducting fluid 6. An air reservoir 7 of sufficient volume is to be provided because of the thermal expansion of fluid 6. The air reservoir can usefully also be located in a volume external to the space but connected to the latter. This means that the actor can always be surrounded completely by heat coupling Fluid 6. In this case fluid 6 can for example be separated by an elastic membrane (not shown) from air reservoir 7 to avoid mixing.

Overall an impermissible warming up of the actor even at high operating frequencies can be safely avoided since both open and also closed actors can be part filled in the manner according to the invention with heat coupling fluid 6.

What is claimed is:

1. Injector for use as a fuel injection valve of motor vehicles, comprising a piezoelectric actor body having a jacket surface surrounded by an injector housing, so that an intermediate space is defined between said jacket surface and said injector housing, said actor body being cooled by direct contact with an inert fluid which does not conduct electricity, wherein said intermediate space is formed filled with the inert fluid, which is a heat coupling fluid, except for an air reservoir, so that the actor body is in direct contact with the fluid over at least part of its length, the fluid removing heat from the actor body in a lateral direction from the actor body, and so that the volume of the air reservoir is at least as large as to allow the expansion of the heat coupling fluid which occurs at the highest operating temperature of the actor body.

2. Injector according to claim 1, wherein the space forms at least a part of the fluid area and is filled over at least part of its length with the fluid and in the injector housing a separation facility is provided in the area of a valve-side end of the actor housing so that it seals the fluid-filled part of the fluid space against a space adjacent to the injector valve in the injector housing.

3. Injector according to claim 2, wherein the actor body is within a tubular spring located in the space and is pretensioned by said tubular spring, said fluid forms a heat conducting bridge through openings of the tubular spring between the actor body and the injector housing.

4. Injector according to claim 1, wherein the actor body is incorporated into an axial encapsulation positioned in the space which divides the space into an actor internal space and an actor external space hydraulically sealed against it, whereby the actor internal space forms at least a part of the fluid space and is filled with fluid over at least a part of its length.

5. Injector according to claim 4, wherein the actor external space is filled over at least a part of its length with a second heat coupling fluid.

6. Injector according to claim 5, wherein a dynamic hydraulic bearing rigidly supporting the actor body on a side away from the valve needle is provided, the hydraulic support and actor external space are hydraulically connected and are filled with a hydraulic liquid serving as a second heat coupling fluid, and a sealing element is provided in which the actor external space is sealed against a space adjacent to the injector valve (V) in the injector housing.

7. Injector in accordance with claim 4, wherein the encapsulation is formed by an axially flexible metal bellows and that the actor body is pretensioned by this.

8. Injector in accordance with claim 1, wherein the actor body is in direct contact with the fluid over its entire length and the volume of the air reservoir is connected without any hydraulic restriction with the fluid-filled part of the fluid space.

9. Injector according to claim 8, wherein an elastic membrane is provided between the air reservoir and the fluid-filled part of the fluid space.

10. Injector in accordance with claim 1, wherein the injector housing features holes for electrical connecting leads of the actor and at least one of these holes is provided as a filling channel for the fluid space.

11. Injector in accordance with claim 1, wherein the heat coupling fluid has a high dielectric constant.

12. Injector in accordance with claim 1, wherein the piezoelectric actor body has multilayer design.

13. A fuel injector, comprising:

a piezoelectric actor body;

an injector housing surrounding said actor body so as to define an intermediate space between said injector housing and said actor body; and an inert, nonelectrically conductive fluid sealedly contained within said intermediate space, wherein said intermediate space is filled with said fluid except for an air reservoir, so that said actor body is in direct contact with the fluid over at least part of its length, said fluid removing heat from the actor body so that said actor body is cooled by the fluid.

14. The fuel injector according to claim 13, further comprising a separation member provided in an area of a valve-side end of the actor body, said separation member seals the fluid-filled part of the intermediate space against a space adjacent to an injector valve in the injector housing.

15. The fuel injector according to claim 14, further comprising a tubular spring in the intermediate space and surrounding the actor body, said tubular spring pretensioning said actor body, said fluid forming a heat conducting bridge through openings of the tubular spring between the actor body and the injector housing.

16. The fuel injector in accordance with claim 13, wherein said injector housing includes holes for connecting electrical leads to said actor body, at least one of said holes being provided as a filling channel for the intermediate space.

17. The fuel injector in accordance with claim 13, wherein the fluid has a high dielectric constant.

18. The fuel injector in accordance with claim 1, wherein the piezoelectric actor body has multilayer design.

19. An injector for use as a fuel injection valve of motor vehicles, comprising:

a piezoelectric actor body having a jacket surface surrounded by an injector housing so as to define a sealable intermediate space therebetween, said actor body being cooled by direct contact with an inert liquid which does not conduct electricity, said intermediate space being filled with the inert liquid except for an air reservoir, so that said actor body is in direct contact with the inert fluid over at least part of a length of said actor body, the inert fluid removing heat from the actor body in a lateral direction from the actor body, a volume of the air reservoir being at least as large as to allow the expansion of the inert fluid which occurs at the highest operating temperature of the actor body.

20. The injector in accordance with claim 19, wherein the liquid is one of silicon oil and glycerin.

* * * * *